United States Patent [19]

Dopp

[11] 4,002,349

[45] Jan. 11, 1977

[54] SKI CLIP DEVICE

[76] Inventor: Kip H. Dopp, 810 7th Ave., Salt Lake City, Utah 84103

[22] Filed: Nov. 24, 1975

[21] Appl. No.: 634,427

[52] U.S. Cl. ..... 280/11.37 A; 24/73 SG; 24/81 SK

[51] Int. Cl.[2] ..... A63C 11/02

[58] Field of Search ..... 280/11.37 A, 11.37 K, 280/11.37 E, 11.37 C, 11.37 R; 224/5 Z, 45 S; 24/81 SK, 73 SG; 211/60 SK

[56] References Cited

UNITED STATES PATENTS

| | | | |
|---|---|---|---|
| 3,486,672 | 12/1969 | Esopi | 224/45 S |
| 3,626,553 | 12/1971 | Darney et al. | 280/11.37 A X |
| 3,683,462 | 8/1972 | Voigt | 280/11.37 A X |
| 3,861,701 | 1/1975 | Aring et al. | 280/11.37 A |

FOREIGN PATENTS OR APPLICATIONS

| | | | |
|---|---|---|---|
| 593,957 | 3/1934 | Germany | 280/11.37 A |

*Primary Examiner*—Philip Goodman
*Assistant Examiner*—Milton L. Smith
*Attorney, Agent, or Firm*—Criddle, Thorpe & Western

[57] ABSTRACT

A ski clip device for securing a pair of skis together in a base to base relationship and for holding a ski pole. The device includes first and second generally elongate clip members, each of which is formed to present a generally arcuate cross section defining a channel therein, with each end of the clip members being open. The clip members are attached together in a back to back relationship so that the channels thereof face in generally opposite directions. The channel of the first clip member is dimensioned to receive thereinto a portion of the sides of a pair of skis and the channel of the second clip member is dimensioned to receive the shank of a ski pole.

13 Claims, 3 Drawing Figures

SKI CLIP DEVICE

BACKGROUND OF THE INVENTION

This invention relates to devices for securing skis together.

The sport of snow skiing has become increasingly popular in recent years, and with this popularity, a variety of new ski accessories have been developed. However, little has been done in the way of developing simple and convenient apparatus or devices for facilitating the carrying and storage of the skis and ski poles. Straps have typically been used for holding a pair of skis together to prevent the skis from sliding apart while being transported, but such straps are generally difficult to attach and detach. Further, even though the securing of the skis together does facilitate carrying the skis, the ski poles and possibly other accessories must also generally be carried and this can be quite cumbersome.

SUMMARY OF THE INVENTION

It is an object of the present invention to provide a simple and inexpensive ski clip structure for securing a pair of skis in a back to back relationship.

It is another object of the present invention to provide such a ski clip which is easily mounted or fitted onto the skis and easily detached therefrom.

It is a further object of the present invention to provide a compact and yet rugged ski clip structure for securing skis together.

It is an additional object of the present invention, in accordance with one aspect thereof, to provide a ski clip structure suitable for securing a pair of skis together and also for holding ski poles in close proximity to the skis.

It is still a further object of the present invention, in accordance with another aspect thereof, to provide a ski clip structure in which the ski clip may be readily attached to a ski pole when not in use in securing the skis together.

The above and other objects of the present invention are realized in one illustrative embodiment of a ski clip which includes a body having a first channel formed therein and open at each end, the interior walls of the channel being formed to present a generally U-shaped cross section dimensioned to receive thereinto a portion of the sides of a pair of skis. Advantageously the body is constructed of an elastic material to allow flexing of the side walls of the channel. In accordance with one aspect of the invention, a second channel is formed in the body to face in a direction generally opposite that of the first channel. The second channel is open at each end and is dimensioned to fit about the shank of a ski pole to securely hold the pole.

Two ski clips of the type described can be employed to secure not only a pair of skis together in a base to base relationship but also to hold a pair of ski poles in close proximity to the skis to provide a more compact package for carrying purposes. Each ski clip would be fitted over one side of the pair of skis, with the skis being received into the first channel of each ski clip, and then each ski pole would be inserted into the second channel of a different one of the ski clips so that the ski poles would be positioned on either side of the pair of skis.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
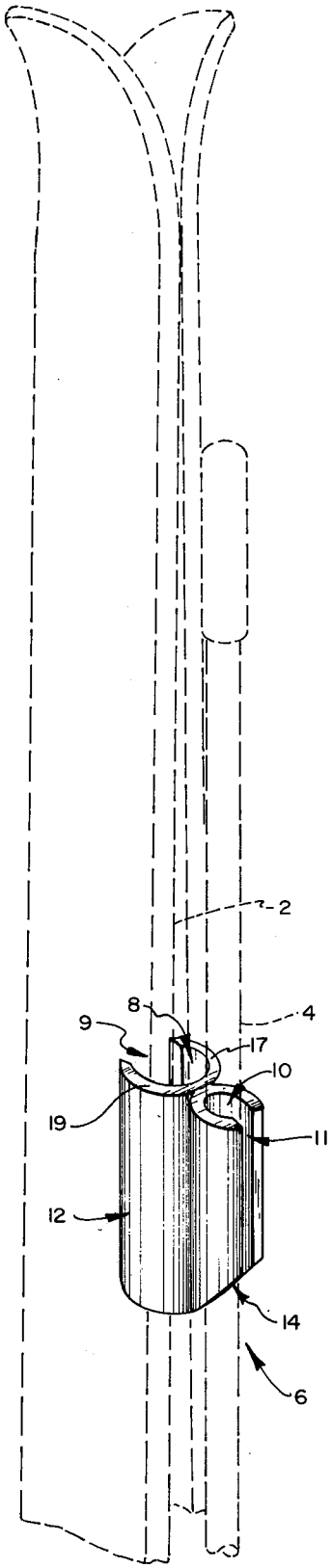
FIG. 1 is a perspective view of a ski clip structure made in accordance with the present invention.

Referring to FIG. 1, there is shown a ski clip adapted to secure a pair of skis 2 together in a base to base relationship as shown in the drawing. The ski clip is also adapted to hold a ski pole 4 in a position proximate to the edges of the pair of skis 2.

The ski clip includes an elongate body 6 formed to define a pair of channels 8 and 10. The body 6 might, for example, be constructed of a pair of tubular members 12 and 14 attached together in a back to back relationship so that the respective channels 8 and 10 face generally in opposite directions. The body 6 advantageously is constructed of an elastic material such as plastic nylon, polyurethane, etc., to allow flexing of the walls of the channels.

Figure 2:
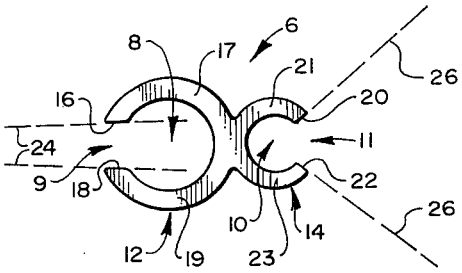
FIG. 2 is a top plan view of the ski clip of FIG. 1.

The interior walls of each channel are formed to present a generally arcuate or demicircular cross section as best seen in FIG. 2. The tubular members 12 and 14 are open at each end and on opposite sides, with the sides of the channel openings being defined by outer terminations 16, 18 and 22 of side walls 17, 19, 21 and 23 of the tubular members.

The channel 8 and the side opening 9 thereof are dimensioned to receive thereinto a portion of the sides of a pair of skis 2 positioned in the base to base relationship as generally shown in FIG. 1. The side walls 17 and 19 of the tubular member 2 curve over respective top surfaces of the skis 2 to contact the surfaces at the upper terminations 16 and 18 of the side walls. These upper terminations 16 and 18 are formed into generally flat surfaces defining planes which converge at a locus located outwardly of the channel opening 9, as indicated by the dotted lines 24. When the ski clip is placed over the sides of a pair of skis which have been positioned base to base, the normal camber of the skis tend to force the upper surfaces of the skis against the terminations 16 and 18 of the side walls 17 and 19 to force the side walls apart slightly until the flat surfaces of the terminations make substantially maximum contact with the upper surfaces of the pair of skis. With such maximum contact, the ski clip tends to "grip" the skis to hold them securely together.

Figure 3:
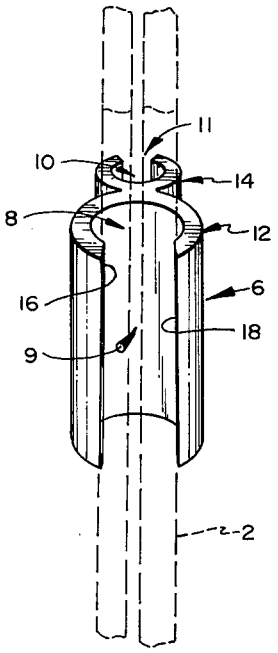
FIG. 3 is a perspective view looking into one of the channels of the ski clip of FIG. 1.

As best seen in FIG. 3, the side opening 9 of the channel 8 is tapered to accommodate the taper of the top surfaces of the skis when the skis are positioned in the base to base relationship. The taper of the channel opening 9 is such that the opening widens along the downward direction of the opening (for the positioning in FIG. 3). This taper, along with the surface formation of the side wall terminations 16 and 18, allows maximum contact between the upper surfaces of the pair of skis and the surfaces of the terminations.

The outer terminations 20 and 22 of the side walls 21 and 23 of the tubular member 14 are similarly formed into generally flat surfaces defining planes which, unlike the terminations 16 and 18 diverge outwardly of the channel opening 11 as generally indicated by the dotted lines 26 of FIG. 2. With this configuration, the shank of a ski pole may be readily inserted through the side opening 11 of the channel 10 to be securely held within the channel as generally indicated in FIG. 1. The elasticity of the body 6 enables the flexing a part of the side walls of the tubular member 14 to allow insertion and removal of the shank of a ski pole. Because the end terminations of the tubular member 14 slope toward one another from the back of the member toward the channel opening 11 so that the member 14, and especially the side walls 21 and 23, contain less material than do the tubular member 12 and side walls 17 and 19, the side walls 21 and 23 are somewhat more flexible than are the walls 17 and 19.

With the ski clip structure described above, a pair of such ski clips may be fitted with their channels 8 over opposite sides of a pair of skis positioned in a base to base relationship to secure the skis together. The two ski poles may then be inserted into the channels 10 of respective clips so that the clips hold the skis and ski poles in one compact and convenient package. This facilitates both the transportation and storage of the skis and ski poles. When the clips are removed from the skis for skiing, the clips may be left on the ski poles for "storage" until they are again used to secure the skis together. Since the ski clips can be made of a fairly lightweight material, placement of the clips on the poles during the skiing should not be a hinderance.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements. For example, the ski clip shown could be permanently mounted on a ski pole with the tubular member 14 permanently attached to the pole by a suitable adhesive. Also, although arcuate or demicircular cross sections are shown for the two tubular members 12 and 14, other cross section configurations could be provided so long as the two members would respectively fit over the edges of a pair of skis and about the shank of a ski pole.

What is claimed is:

1. A device for securing a pair of skis together in a base to base relationship, said device comprising a first clip member which includes a bottom wall and side walls formed to present a generally U-shaped cross section defining a generally elongate channel therein, each end of said clip member being open and the outer terminations of the side walls defining the sides of the opening of the channel, said channel being dimensioned to receive thereinto a portion of the sides of the pair of skis and the outer terminations of the side walls being formed into generally flat surfaces, with the sides of the channel opening being tapered to accommodate the taper of the top surfaces of the skis when positioned in a base to base relationship, the generally flat surfaces of the outer terminations thereby contacting and gripping the top surfaces of the skis to hold the skis together.

2. A device as in claim 1 wherein said clip member is constructed of elastic material.

3. A device as in claim 2 wherein the generally flat surfaces of the outer terminations of the side walls of the clip member define planes which converge at a locus located outwardly of the channel opening.

4. A device as in claim 2 further comprising a second clip member which includes a bottom wall and side walls formed to present a generally U-shaped cross section defining a channel therein, each end of said second clip member being open and the outer terminations of the side walls defining the sides of the opening of the channel in the second clip member, said channel of the second clip member being dimensioned to receive thereinto the shank of a ski pole, said first and second clip members being attached together so that the channel openings thereof are generally parallel.

5. A device as in claim 4 wherein the channel of the first clip members opens in a direction generally opposite the direction in which the channel of the second clip member opens.

6. A device as in claim 5 wherein the upper terminations of the side walls of the second clip member are formed into generally flat surfaces defining planes which diverge outwardly of the channel opening.

7. A device as in claim 5 wherein one end of the second clip member is formed to slope in such a manner that the back wall of the second clip member is longer than the channel opening thereof.

8. A device as in claim 4 wherein the cross sections of the first and second clip members are generally demicircular.

9. A clip device for securing a pair of skis together in a base to base relationship comprising a body having a first channel formed therein and open at each end, the interior walls of the channel being formed to present a generally arcuate cross section so that the width of the channel opening is less than the greatest distance separating the inerior walls of the channel, said channel being dimensioned to receive thereinto a portion of the sides of the pair of skis and the channel opening being tapered along the length thereof to accommodate the camber of the skis when placed in a base to base relationship.

10. A clip device as in claim 9 wherein said body is constructed of an elastic material.

11. A clip device as in claim 10 wherein the side edges of the channel opening are formed to define generally flat surfaces which lie in planes which converge outwardly of the channel opening.

12. A clip device as in claim 10 further including means for attaching said body to a ski pole so that the channel faces outwardly of the ski pole.

13. A clip device as in claim 10 wherein said body has a second channel formed therein and open at either end, the interior walls of the second channel being formed to present a generally demicircular cross section dimensioned to fit about the shank of a ski pole, said first and second channels being formed to face in generally opposite directions.

* * * * *